US008477985B2

(12) United States Patent
Kim et al.

(10) Patent No.: US 8,477,985 B2
(45) Date of Patent: Jul. 2, 2013

(54) CUSTOMIZED EARPHONE

(75) Inventors: Jun-Tai Kim, Yongin-si (KR); Jung-Eun Han, Eunpyeong-gu (KR); Eun-Jung Song, Yongsan-gu (KR); Jung-Ae Choi, Anyang-si (KR)

(73) Assignee: Samsung Electronics Ltd., Co., Suwon-si (KR)

( * ) Notice: Subject to any disclaimer, the term of this patent is extended or adjusted under 35 U.S.C. 154(b) by 248 days.

(21) Appl. No.: 12/961,882

(22) Filed: Dec. 7, 2010

(65) Prior Publication Data

US 2011/0135136 A1 Jun. 9, 2011

(30) Foreign Application Priority Data

Dec. 9, 2009 (KR) ..... 10-2009-0121490

(51) Int. Cl.
*H04R 25/00* (2006.01)

(52) U.S. Cl.
USPC ..... 381/380; 381/328; 181/135

(58) Field of Classification Search
USPC ..... 381/328–330, 381–382, 370, 371, 381/374–378; 181/135, 137, 180
See application file for complete search history.

(56) References Cited

U.S. PATENT DOCUMENTS

| | | | | |
|---|---|---|---|---|
| 2,529,562 | A * | 11/1950 | Martin | 381/372 |
| 4,133,984 | A * | 1/1979 | Akiyama | 381/328 |
| 5,321,757 | A * | 6/1994 | Woodfill, Jr. | 381/312 |
| 5,692,059 | A * | 11/1997 | Kruger | 381/151 |
| 8,139,806 | B2 * | 3/2012 | Hosaka et al. | 381/373 |
| 8,194,910 | B2 * | 6/2012 | Uchida et al. | 381/370 |
| 2004/0215053 | A1 * | 10/2004 | Jorgensen et al. | 600/25 |
| 2010/0303275 | A1 * | 12/2010 | Creek | 381/380 |

* cited by examiner

*Primary Examiner* — Mohammad Islam
*Assistant Examiner* — Phylesha Dabney
(74) *Attorney, Agent, or Firm* — Jefferson IP Law, LLP

(57) ABSTRACT

An earphone and method for forming the same are provided. The earphone includes an earphone housing, a speaker, and an earcap. The earphone housing includes a speaker mounting portion. The speaker is fixed to the earphone housing, and has a cable that passes through the body and is drawn from the body. The earcap is installed to at least partially enclose the speaker and the housing, and has at least one speaker sound emitting hole therein. The earcap is made of a material that solidifies after a predetermined time elapses, and is manufactured by inserting the material into an ear of a user, and then solidifying the material such that it is suited for a shape of the ear of the user.

20 Claims, 4 Drawing Sheets

CUSTOMIZED EARPHONE

PRIORITY

This application claims the benefit under 35 U.S.C. §119 (a) of a Korean patent application filed in the Korean Intellectual Property Office on Dec. 9, 2009 and assigned Serial No. 10-2009-0121490, the entire disclosure of which is hereby incorporated by reference.

BACKGROUND OF THE INVENTION

1. Field of the Invention

The present invention relates to an earphone receiver. More particularly, the present invention relates to an earphone that provides improved sound quality suitable for the hearing characteristics of a user and provides excellent wear sensation by providing an individual earcap suitable for the user's ear.

2. Description of the Related Art

As the electronics industry has developed, various multimedia apparatuses have emerged. One advanced characteristic of these multimedia apparatuses is the maximization of portability. Examples of such multimedia apparatuses include mobile terminals that are exploiting convergence such as portable Motion Picture Expert Group Audio Layer-3 (MP3) players, portable multimedia players, and various portable game apparatuses. Since these apparatuses are small and meant to be carried by users in public, users primarily use an earphone electrically connected to an earphone jack installed in a relevant apparatus rather than using a loud speaker built into the apparatus in order to enjoy the audio output of the apparatus and not to hinder other people.

Generally, the earphone includes two receivers that can be respectively mounted in or on a user's two ears, each receiver having a cable with a predetermined length. One receiver is electrically connected to one end of the cable. The other end of the cable has an earphone connector that can be connected to an earphone jack or a connector of an apparatus. Furthermore, an earphone apparatus for use with a mobile communication terminal may also have a microphone unit that can transmit a user's voice.

The above-described earphone is an abbreviation of an earphone receiver, and denotes a receiver designed to have a small size so that it can be mounted in or on a user's ear. Structurally, the earphone may be classified into a crystal receiver and a magnetic receiver. The crystal receiver operates a vibrating plate using a piezo-electric effect of a crystal device. The magnetic receiver operates a vibrating plate by allowing a voice current to directly flow through a coil.

The above earphone fixes a small speaker using a specific housing to be inserted into a user's ear and connects an access end, integrally connected to the earphone, to the above apparatus to allow a sound form of the speaker integrally mounted on the earphone to be directly emitted to the user's ear so that the user is able to hear sounds output from a connected device. The earphone is used primarily in an indoor space so that the user can enjoy sounds output from a connected device without hindering neighboring people, or manufactured for a portable use in an elegant appearance so that it is conveniently used in the outside and produced through mass production.

Under these circumstances, the structure of the earphone is designed such that it minimizes any pain in a user's ear, even when it is used for a long time, and designed such that the waveform of a received sound transmitted from a speaker is uniform so that a sound source can be heard without breakup.

Typically, an earphone is designed having an earcap, which is the part of the earphone placed in the user's ear, with a uniform shape. However, such a uniform shape cannot accommodate the varying physical parameters of different users' ears. In addition, even when the earphone has an optimized sound emission structure, it cannot accommodate the varying auditory senses which are different for each person.

Accordingly, there is a need for an earphone having an earcap that may be customized for each user's physical and auditory characteristics.

SUMMARY OF THE INVENTION

An aspect of the present invention is to address at least the above-mentioned problems and/or disadvantages and to provide at least the advantages described below. Accordingly, an aspect of the present invention is to provide a customized earphone realized such that inconvenience is minimized even when it is worn for a long time by custom-manufacturing the earphone so that it is adapted for the ear of a user.

Another aspect of the present invention is to provide a customized earphone realized such that it has excellent senses of adherence and airtightness by applying an earcap manufactured to be accurately suited for an ear of a user.

Still another aspect of the present invention is to provide a customized earphone having a structure for correcting a sense of hearing that reflects a hearing characteristic of an individual.

In accordance with an aspect of the present invention, an earphone is provided. The earphone includes an earphone housing including a speaker mounting portion, a speaker fixed to the earphone housing, a cable, electrically connected to the speaker, that passes through the body and is drawn from the earphone housing, and an earcap at least partially enclosing the speaker and the housing, and having at least one speaker sound emitting hole therein, wherein the earcap is made of a material that solidifies after a predetermined time elapses, and is manufactured by inserting the material into an ear of a user of the earphone, and then solidifying the material such that it is suited for a shape of the ear of the user.

In accordance with another aspect of the present invention, a method for forming an earphone is provided. The method includes providing an earphone housing including a speaker mounting portion, providing a speaker fixed to the earphone housing, providing a cable, electrically connected to the speaker, that passes through and is drawn from the earphone housing, and providing an earcap, at least partially enclosing the speaker and the earphone housing and having at least one speaker sound emitting hole therein, by inserting a material that solidifies after a predetermined time elapses into an ear of a user, and solidifying the material such that it is suited for a shape of the ear of the user.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 1:
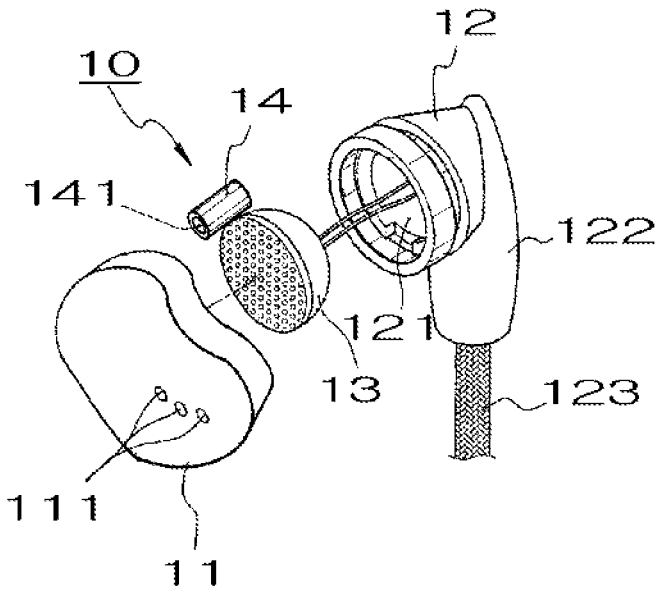
FIG. 1 is a separated perspective view illustrating a customized earphone according to an exemplary embodiment of the present invention.
Figure 2:
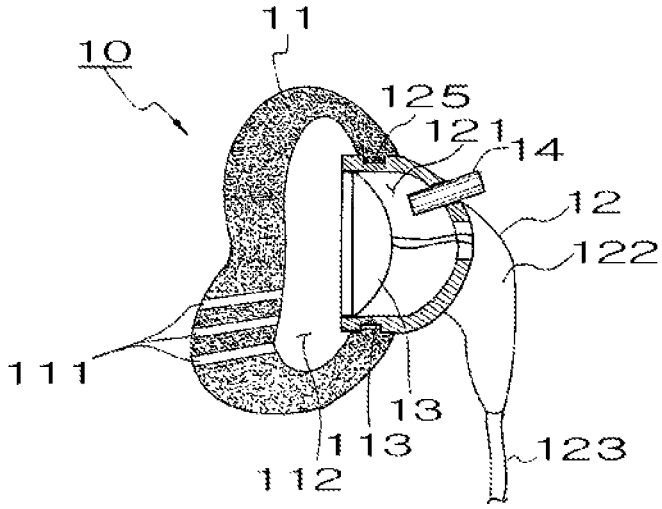
FIG. 2 is a cross-sectional view illustrating a customized earphone according to an exemplary embodiment of the present invention.

FIG. 1 is a separated perspective view illustrating a customized earphone according to an exemplary embodiment of the present invention. FIG. 2 is a cross-sectional view illustrating a customized earphone according to an exemplary embodiment of the present invention.

Referring to FIGS. 1 and 2, the customized earphone 10 includes a housing 12 including an earphone body 122, a speaker 13 installed in a speaker mounting portion 121 of the housing 12, an earcap 11 fixed in the housing 12 with the speaker 13 and mounted on the housing 12, and a tube 14 for correcting a sense of hearing, having a structure customized for an individual's optimized sense of hearing.

The speaker mounting portion 121 is formed in the housing 12 of the earphone 10, and the speaker 13 having predetermined power is mounted on the speaker mounting portion 121. The body 122 is integrally formed with the housing 12 and is formed in a shape that is advantageous for a user's gripping or handling. A cable 123, having a predetermined length, passes from the lower portion of the body 122 through the body 122 for electrical connection with speaker 13. Also, the cable 123 extends from the body 122 and is electrically connected with an earjack (not shown) or a connector (not shown). The earjack or the connector may be connected to a relevant apparatus.

The customized earcap 11, mounted on an end of the earphone housing 12, has a shape that is formed by injecting a malleable material from the inner side to the outer side of a user's ear. The malleable material solidifies to thus form a customized earcap 11 in a shape suitable for being mounted in the ear of each user. Therefore, since the earcap 11 of the customized earphone 10 needs to be formed to be suited for the shape of an ear of a first user, a material having a predetermined viscosity that solidifies when a time elapses is used for the earcap 11. For the customized earcap 11, silicon or rubber that does not harm a human body may be used.

Figure 3:
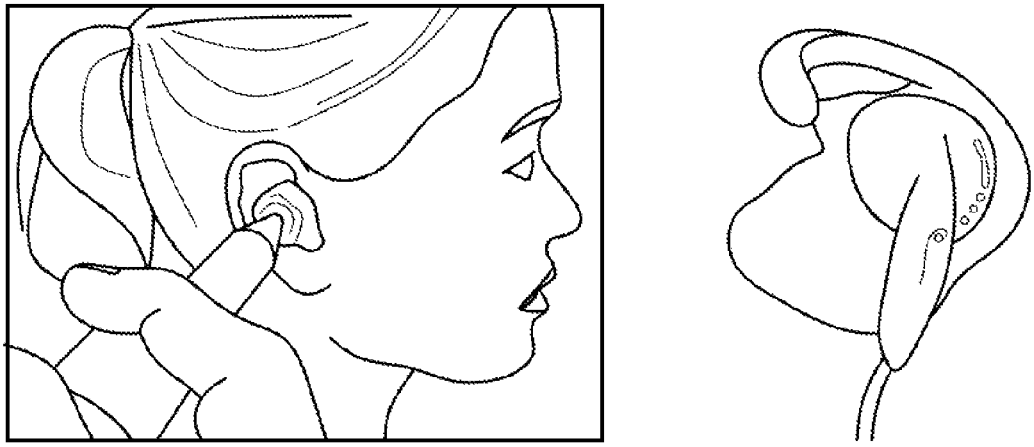
FIG. 3 is a picture illustrating manufacturing of an earcap of a customized earphone and an applied state according to an exemplary embodiment of the present invention.

FIG. 3 is a picture illustrating manufacturing of an earcap of a customized earphone and an applied state according to an exemplary embodiment of the present invention.

Referring to FIG. 3, initially, a material such as silicon is injected into a user's ear using a predetermined injector. After an appropriate setting time of the injected material elapses, the earcap 11 is solidified. At this point, at least one speaker sound emitting hole 111 for transferring a sound emitted from the speaker to the user's ear may be formed. In an exemplary implementation, before the customized earcap 11 is solidified, the housing 12 to which the speaker is coupled is infiltrated into the earcap to some extent and then solidified together, so that the assembly process is completed.

However, the assembly process is not limited thereto. The customized earphone 11 may be solidified first and then structural coupling with the housing 12 may be performed. In this case, if the earcap 11 needs to be replaced due to, for example, destruction of the earcap 11, the earcap 11 may be easily separated from the housing 12.

As illustrated in FIG. 2, to enhance a coupling force when the earphone housing 12 is coupled to the earcap 11 before solidification, a recess 125 may be formed in the periphery of the earphone housing 12. The recess 125 allows a portion 113 of the earcap 11 to be inserted into the recess 125, so that the coupling force may be enhanced.

Since structures of an ear such as an earflap, an ear lobe, an eardrum, and the like are slightly different for all people, an optimized pitch according to a frequency band is different for each individual. However, the conventional earphone has a sound pressure emitting hole of a uniform shape formed in the rear side of the earphone housing. The emitting hole for emitting a sound pressure is very important, as described in more detail below.

Figure 4:
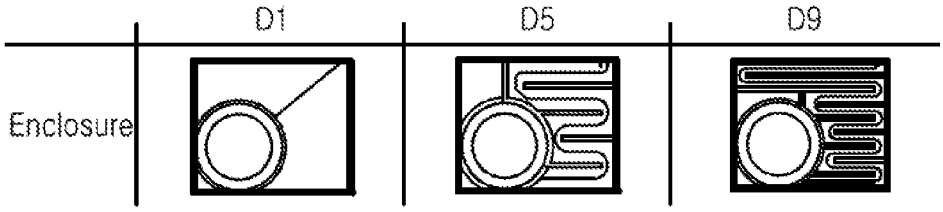
FIG. 4 is a graph illustrating various waveforms depending on a structure of a bent hole of an earphone according to an exemplary embodiment of the present invention.
Figure 4:
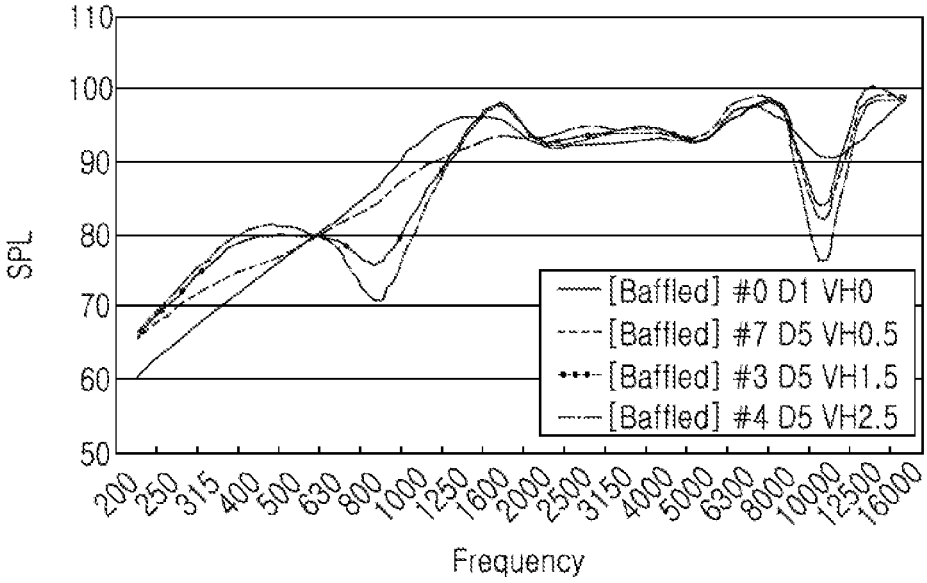
Figure 4:
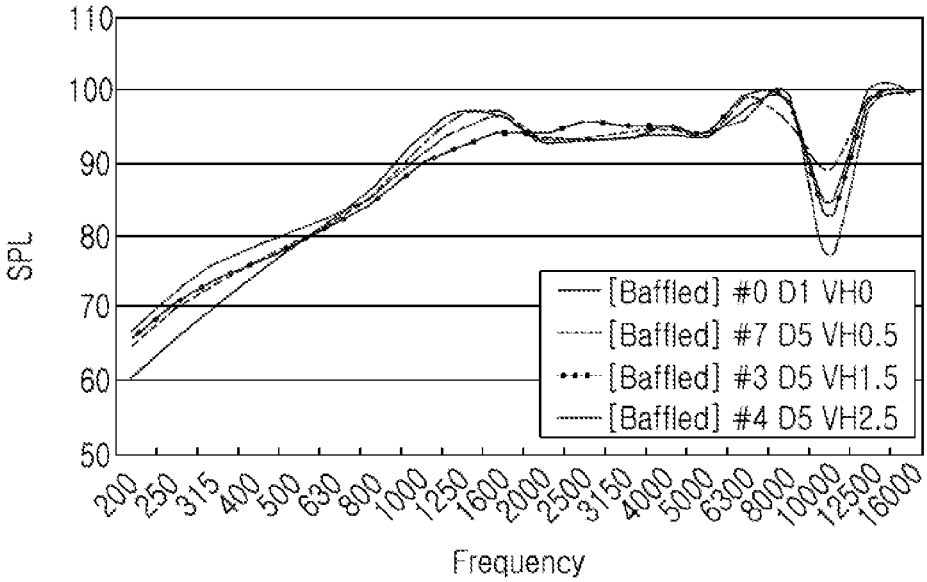

FIG. 4 is a graph illustrating various waveforms depending on a structure of a bent hole of an earphone according to an exemplary embodiment of the present invention.

Referring to FIG. 4, a specific band may be boosted depending on changes of the length of an outlet inside the earphone, the area of a bent hole, etc. For example, as illustrated in FIG. 4, waveforms change depending on the length of the outlet and the area of the vent hole. In FIG. 4, the solid curve is a default, and the other curves are waveforms depending on changes of the above conditions.

According to an exemplary embodiment of the present invention, the tube 14 is provided for correcting the sense of hearing for each user. That is, the tube 14 provides an optimized sound quality for each user based on the above description. The tube 14 for correcting the sense of hearing has an opening 141 of a predetermined shape. One end of the tube 14 is infiltrated into the earphone 10, and the other end of the tube 14 is exposed to the outside. The tube 14 for correcting the sense of hearing may have various lengths and various shapes in the opening depending on a user's hearing characteristic. In the drawing, the tube 14 for correcting the sense of hearing is installed in the speaker mounting portion 121 of the earphone housing 12, that is, the rear side of the speaker.

However, it is not limited thereto. For example, when the speaker 13 is not installed in the housing 12 of the earphone but is installed in a portion of the earcap 11, that is, in the speaker mounting portion 112 of the earcap, the tube 14 for correcting the sense of hearing may be directly installed in the earcap 11.

Since the earcap of the earphone according to an exemplary embodiment of the present invention is manufactured and applied so that it is suited for a user's ear, a wear sensation is improved even when it is worn for a long time. In addition, since the earphone according to an exemplary embodiment of the present invention has a speaker sound emitting structure suitable for the sense of hearing of a relevant user, an earphone having an excellent performance may be provided.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An earphone comprising:

an earphone housing including a speaker mounting portion;

a speaker fixed to the earphone housing;

a cable, electrically connected to the speaker, that passes through and is drawn from the earphone housing; and an earcap at least partially enclosing the speaker and the earphone housing, and having at least one speaker sound emitting hole therein, wherein the earcap is made of a material that solidifies after a predetermined time elapses, and is manufactured by inserting the material into an ear of a user, and then solidifying the material such that it is suited for a shape of the ear of the user.

2. The earphone of claim 1, wherein the earcap is formed by injecting at least one of silicon and a rubber material that is unharmful to a human body and has a predetermined viscosity, and solidifying the same in the user's ear.

3. The earphone of claim 2, wherein portions of the speaker and the earphone housing are infiltrated into the earcap before the at least one of silicon and the rubber material is solidified.

4. The earphone of claim 1, wherein the at least one speaker sound emitting hole is formed in the earcap while the earcap is solidified.

5. The earphone of claim 3, wherein a recess is formed along a periphery of the earphone housing and a portion of the at least one of silicon and rubber material is infiltrated into the recess and solidification is performed.

6. The earphone of claim 2, wherein the speaker and the earphone housing are inserted into the earcap after the earcap has solidified.

7. The earphone of claim 1, further comprising:

a tube for correcting a sense of hearing having a sound pressure emitting structure that is suited for a hearing characteristic of a relevant user.

8. The earphone of claim 7, wherein the tube for correcting the sense of hearing has a cavity type opening, and the opening has a length and a shape most suitable for a sense of hearing of a relevant user.

9. The earphone of claim 8, wherein the tube for correcting the sense of hearing is installed in a rear space of the speaker, and one end of the tube is disposed in an inner space of the earphone and the other end of the tube is exposed to an outside of the earphone.

10. The earphone of claim 9, wherein the tube for correcting the sense of hearing is installed in a space of the earphone housing, which is the rear space of the speaker, while the speaker is installed in the earphone housing.

11. The earphone of claim 9, wherein the tube for correcting the sense of hearing is installed in a space of an earcap, which is the rear space of the speaker, while the speaker is installed in the earcap.

12. A method of forming an earphone, the method comprising:

providing an earphone housing including a speaker mounting portion;

providing a speaker fixed to the earphone housing;

providing a cable, electrically connected to the speaker, that passes through and is drawn from the earphone housing; and providing an earcap, at least partially enclosing the speaker and the earphone housing and having at least one speaker sound emitting hole therein, by inserting a material that solidifies after a predetermined time elapses into an ear of a user, and solidifying the material such that it is suited for a shape of the ear of the user.

13. The method of claim 12, wherein the earcap is provided by injecting at least one of silicon and a rubber material that is unharmful to a human body and has a predetermined viscosity, and solidifying the same in the user's ear.

14. The method of claim 13, wherein portions of the speaker and the earphone housing are infiltrated into the earcap before the at least one of silicon and the rubber material is solidified.

15. The method of claim 12, wherein the at least one speaker sound emitting hole is formed in the earcap while the earcap is solidified.

16. The method of claim 14, further comprising:

forming a recess along a periphery of the earphone housing such that a portion of the at least one of silicon and the rubber material is infiltrated into the recess before the solidification is performed.

17. The method of claim 13, further comprising:

inserting the speaker and the earphone housing into the earcap after the earcap has solidified.

18. The method of claim 12, further comprising:

providing a tube for correcting a sense of hearing having a sound pressure emitting structure that is suited for a hearing characteristic of a relevant user.

19. The method of claim 18, wherein the tube for correcting the sense of hearing has a cavity type opening, and the opening has a length and a shape most suitable for a sense of hearing of a relevant user.

20. The method of claim 19, wherein the tube for correcting the sense of hearing is installed in a rear space of the speaker, and one end of the tube is disposed in an inner space of the earphone and the other end of the tube is exposed to an outside of the earphone.

* * * * *